US006209422B1

(12) United States Patent
Kamiya et al.

(10) Patent No.: US 6,209,422 B1
(45) Date of Patent: Apr. 3, 2001

(54) RATCHET WRENCH

(75) Inventors: Tadashi Kamiya, Kawasaki; Toshiro Iritani, Sagamihara, both of (JP)

(73) Assignee: K-R Industry Company, Ltd. (JP)

( * ) Notice: Subject to any disclaimer, the term of this patent is extended or adjusted under 35 U.S.C. 154(b) by 0 days.

(21) Appl. No.: 09/404,159

(22) Filed: Sep. 27, 1999

(30) Foreign Application Priority Data

May 17, 1999 (JP) ..... 11-135567
Sep. 16, 1999 (JP) ..... 11-262551

(51) Int. Cl.[7] ..... B25B 13/46
(52) U.S. Cl. ..... 81/57.39; 81/62
(58) Field of Search ..... 81/57.39, 60, 61, 81/62, 63.1

(56) References Cited

U.S. PATENT DOCUMENTS 4,346,630 * 8/1982 Hanson ..... 81/57.39
4,766,784 * 8/1988 Lai ..... 81/57.39
5,537,899 * 7/1996 Diedrich ..... 81/57.39
5,603,393 * 2/1997 Ghode et al. ..... 81/62

* cited by examiner

*Primary Examiner*—David A. Scherbel
*Assistant Examiner*—Joni B. Danganan
(74) *Attorney, Agent, or Firm*—Lorusso & Loud

(57) ABSTRACT

A ratchet wrench is designed to prevent overshooting and unintended switching of drive direction. The ratchet wrench has a wing member 44, which is biased by a spring 58 through a bushing pin 56, wherein an elastic member 66 formed of an elastic material, such as rubber, is incorporated into an axial internal space of the spring 58. Thereby, it is possible to strengthen a pressing force in a direction of holding engagement between a pawl of the wing member 44 and an internal gear 30 of an oscillating member 26. Thereby, in the case where a force is exerted on the wing member 44, in a direction tending to release the engagement between the pawl 46 of the wing member 44 and the internal gear 30 of the oscillating member 26, the spring 58 and of the elastic member 66 exert a reaction force, and the elastic member 66 functions as a stopper to prevent overshooting. Further, since the force holding a switching member 52 to a shank 36 is increased by the spring 58 and the elastic member 66, it is possible to prevent an unintended switching of the drive direction.

14 Claims, 21 Drawing Sheets

RATCHET WRENCH

FIELD OF THE INVENTION

The present invention relates to an improvement in a ratchet wrench used for tightening and loosening bolts and nuts in assembly and disassembly of automobiles, industrial machines and so on.

BACKGROUND OF THE INVENTION

An electrical or hand-operated ratchet wrench has been heretofore used for positively and quickly tightening or removing bolts, nuts or the like. A conventional ratchet wrench is disclosed in U.S. Pat. No. 5,537,899 and the main structure thereof will be explained hereinafter with reference to FIGS. 12 to 19.

As shown in FIG. 12, a housing 10 is internally provided with a motor 12, a conventional motion conversion means 14 for changing rotational speed of the motor 12, and a crank shaft 16 which is mounted for rotational motion and reciprocating sliding motion by the motion conversion means 14.

As shown in FIG. 13, the crank shaft 16 is integrally formed at the extreme end thereof with a core 18 which is eccentric from the center of the shaft and parallel with the center of the shaft, and a bushing 22 having an insert hole 20 is slidably mounted on the core 18. As shown in FIGS. 12 and 14, the housing 10 is integrally formed at the extreme end thereof with a pair of annular holding portions 24, and an oscillating member 26 shown in FIG. 13 is provided between the pair of annular holding portions 24. The oscillating member 26 is formed in the center thereof with a hole 28, and the hole 28 is formed in the inner wall thereof with an internal gear 30. The oscillating member 26 has a pair of arms 32 at the extreme end thereof, and a space 34 is formed between the pair of arms 32. The bushing 22 is rotatably and undisengageably fitted into the space 34.

As shown in FIG. 15, a shank 36 for intermittently rotating bolts or the like comprises a columnar base portion 38 and a cubical engaging portion 40 formed integral with the base portion 38. The base portion 38 of the shank 36 is inserted into the hole 28 of the oscillating member 26. The oscillating member 26 with the shank 36 mounted therein is held between the pair of annular holding portions 24 of the housing 10 shown in FIGS. 12 and 14. As the crank shaft 16 rotates, the oscillating member 26 oscillates about the center axis of the hole 28.

In the shank 36, the columnar base portion 38 is internally provided with two wing members 44 which are oscillatable about a pin 42. Each wing member 44 is formed on both left and right ends thereof with a plurality of pawls 46. The columnar base portion 38 is formed with a central axial hole 48, and a columnar switching member 52 (FIG. 16) integrally formed with a switching knob 50 is fitted into the hole 48. The switching member 52 is mounted for rotation through a given angular range relative to the shank 36.

As shown in FIGS. 16 and 17, the switching member 52 is formed with two axially extending holes 54 with openings opposite each other by 180 degrees. Each hole 54 is internally provided with a tubular bushing pin 56 with one end closed, and one end open to receive a spring 58 internally to bias the bushing pin 56 outwardly from the switching member 52. As shown in FIG. 17, the closed end of the bushing pin 56 is biased by the spring 58 so as to project from the hole 54 into contact with the wing member 44, thereby pressing against the wing member 44.

The switching member 52 is normally and reversely rotated, for example, by approximately 90 degrees, when fitted into the hole 48 of the base portion 38 of the shank 36, by turning the switching knob 50 of the switching member 52, and the switching member 52 maintains one of the two stable positions shown in FIGS. 18 and 19. In FIGS. 18 and 19, each wing member 44 is pressed by the bushing pin 56 and the spring 58 so that the pawl 46 on one of left and right sides of each wing member 46 is engaged with the internal gear 30 of the oscillating member 26. In FIG. 18, the bushing pin 56 presses one side of the wing member 44 which oscillates about the pin 42. The part of the wing member 44 pressed by the bushing pin 56 is shifted from one side to the other of the wing member 44 by turning the switching knob 50 from the position shown in FIG. 18 to that of FIG. 19. By the switching with the switching knob 50, the pawl 46 of each wing member 44 meshed with the internal gear 30 of the oscillating member 26 is switched from one side to the other, thus switching between tightening rotation and loosening rotation.

When the oscillating member 26 is rotated in one direction with one pawl 46 of each wing member 44 engaged with the internal gear 30 of the oscillating member 26, wing members 44 move together with the oscillating member 26. On the other hand, when the oscillating member 26 is rotated in an opposite direction, the pawl 46 of each wing member 44 and the internal gear 30 of the oscillating member 26 come in contact but slip so that they are not engaged, and the wing members 44 will not move together with the oscillating member 26.

Thus, as shown in FIG. 18, when the oscillating member 26 is rotated in direction A, a tightening operation results, and when the oscillating member 26 is rotated in direction B slip occurs. In this manner, the tightening is carried out by repeating the tightening operation and the slip operation. Further, when switched from the FIG. 18 state to the FIG. 19 state, and when the oscillating member 26 is rotated in a direction C, the loosening operation results, and when the oscillating member 26 is rotated in a direction D, slip occurs.

As shown in FIGS. 12 and 14, the engaging portion 40 of the shank 36 is generally cubical in shape, and the engaging portion 40 projects, beyond one annular supporting portion 24 at the distal end of the housing 10, in a direction perpendicular to the length of the housing 14. A socket 60 for transmitting the intermittent rotational force of the ratchet wrench to the bolt or the like is detachably mounted on the engaging portion 40 of the shank 36. The socket 60 is cylindrical, and one end thereof is provided with a first hole 62 which is square in section for mating with the engaging portion 40 of the shank 36, and the other end thereof is provided with a second hole 64 which is hexagonal in section for fitting over a bolt (not shown). When the ratchet wrench is used, the socket 60 is mounted between the engaging portion 40 of the shank 36 and the bolt for tightening or loosening the bolt.

The operation of the ratchet wrench constructed as described above will be explained below.

First, when the motor 12 shown in FIG. 12 is driven, the crank shaft 16 is rotated through the known motion conversion means 14. When the crank shaft 16 is rotated, the core 18 of the crank shaft 16 causes the bushing 22 to rotate in a planetary orbit about the center axis the crank shaft 16. The planetary motion of the bushing 22 causes the oscillating member 26 to oscillate about the center axis of the columnar base portion 38 of the shank 36.

When the oscillating member 26 is oscillated in one direction, the pawl 46 on one side of the wing member 44 mounted on the shank 36 projects and is meshed with the internal gear 30 of the oscillating member 26 to rotate the shank 36 to tighten the bolt or the like (in direction A in FIG. 18). When the oscillating member 26 is oscillated in the opposite direction (B in FIG. 18), the projecting pawl 46 does not mesh with the internal gear 30 and the shank 36 is not rotated. Thereafter, when the oscillating member 26 is rotated in the one direction again, the bolt or the like is tightened. That is, in this ratchet wrench, only when the oscillating member 26 is rotated in one direction, is the shank 36 rotated, so that the bolt or the like is intermittently tightened.

In the ratchet wrench having two wing members 44, when the oscillation of the oscillating member 26 is slow, the pawl 46 of the wing member 44 moves along the internal gear 30 of the oscillating member 26 in a satisfactory manner, but when the oscillating member 26 is oscillated at high speed in order to enhance the working efficiency, a so-called resonant phenomenon caused by variation of oscillation speed occurs in the wing member 44, and "overshoot" occurs such that, as shown in FIG. 20, the pawl 46 of the wing member 44 being meshed with the internal gear 30 of the oscillating member 26 is temporarily moved away from the internal gear 30. When overshoot occurs, return of the wing member 44 into meshing engagement is delayed so that neither of the pawls 46 of the wing member 44 is meshed with the internal gear 30, resulting in a failure of the tightening operation.

When overshoot occurs, the pawl 46, on the side opposite the pawl 46 that should be meshed, sometimes becomes meshed with the internal gear 30 in a " " configuration commonly referred to as a "pigeon-toe" configuration, as shown in FIG. 21. In the state shown in FIG. 21, the shank 36 oscillates with the oscillating member 26, such that the tightening rotation is not produced at all.

In the case of operation at high speed, there is a point where the wing member 44 and the spring 58 begin to oscillate, and this oscillation is amplified (called a resonant point). This resonant point differs depending on the mass of the wing member 44 and the strength of the spring 58, but with high speed rotation there is always a resonant point. At the resonant point overshoot occurs, as described above and as shown in FIGS. 20 and 21, such that the tightening operation cannot be performed.

In the ratchet wrench, the switching member 52 is rotatably mounted on the shank 36, and the switching member 52 rotates along with the shank 36. When the shank 36 carries out the tightening rotation and stops suddenly upon completion of tightening, the switching member 52 incorporated into the shank 36 tends to further rotate due to inertia. At this time, in the case where reaction of the spring 58 is so small that the switching member 52 is not held by the spring 58, the switching member 52 will switch the wrench between the tightening operation and the loosening operation. To prevent such an unintended switching of the switching member 52, a strong spring 58 is employed.

For suppressing the overshoot phenomenon, in the conventional ratchet wrench, either a strong spring 58 is employed, or a stopper may be provided to limit motion of the wing member 44. Further, for preventing unintended switching, the spring 58 may be strengthened. However, in the case of the conventional small spring 58, its strength cannot be adequately increased. Further, while a stopper might be provided to prevent the wing member 44 from moving to an improper position, there is inadequate space for the stopper.

Accordingly an object of the present invention is to provide a ratchet wrench which is free of occurrence of overshoot and unintended switching.

SUMMARY OF THE INVENTION

For achieving the aforementioned object, according to the present invention, there is provided a ratchet wrench, comprising: a housing, an oscillating member having an internal gear mounted oscillatably on the housing, a shank provided with a wing member having pawls meshed with the internal gear on both left and right sides thereof, a switching member mounted on the shank for rotation through given angle, a hole formed in the switching member, a bushing pin provided within the hole, and a spring provided within the hole for pressing said wing member in a direction bringing said pawls of said wing member into contact with said internal gear through said bushing pin, wherein an elastic member inhibiting movement of said bushing pin internally within said hole is provided within said hole.

DETAILED DESCRIPTION OF THE PREFERRED EMBODIMENTS

First Embodiment

A first embodiment of present invention will be described hereinafter with reference to FIGS. 1 AND 2 of the drawings.

Figure 1:
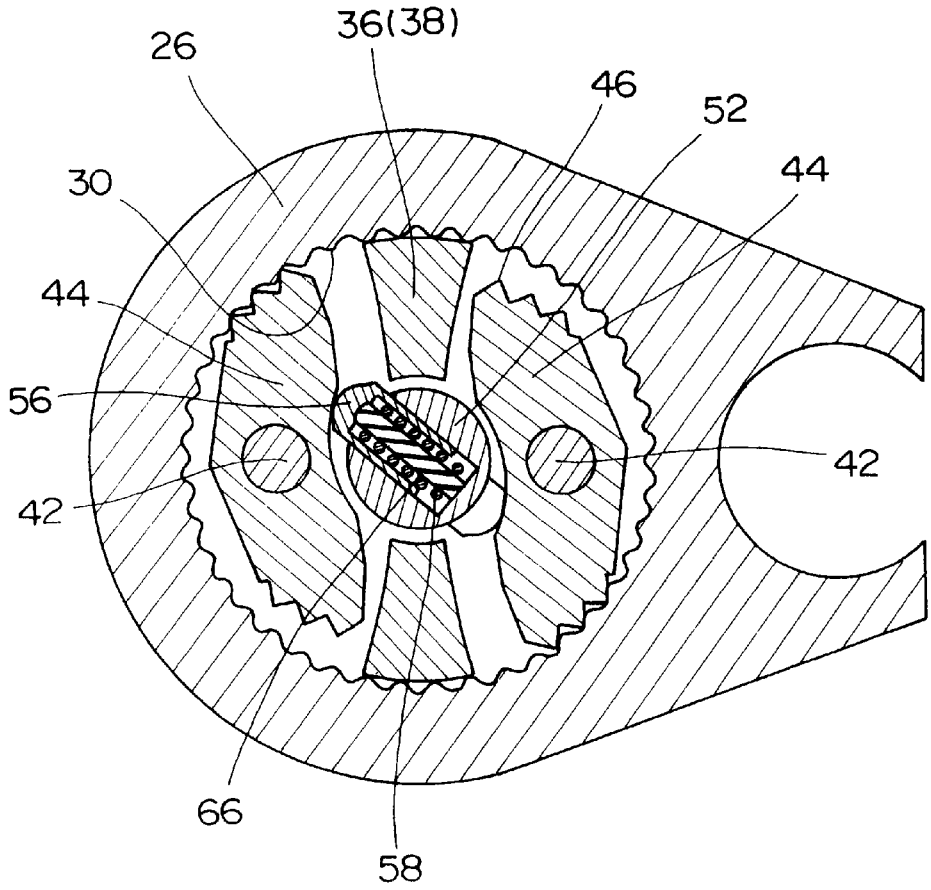
FIG. 1 is a sectional view of main parts of a ratchet wrench according to one embodiment the present invention.
Figure 2:
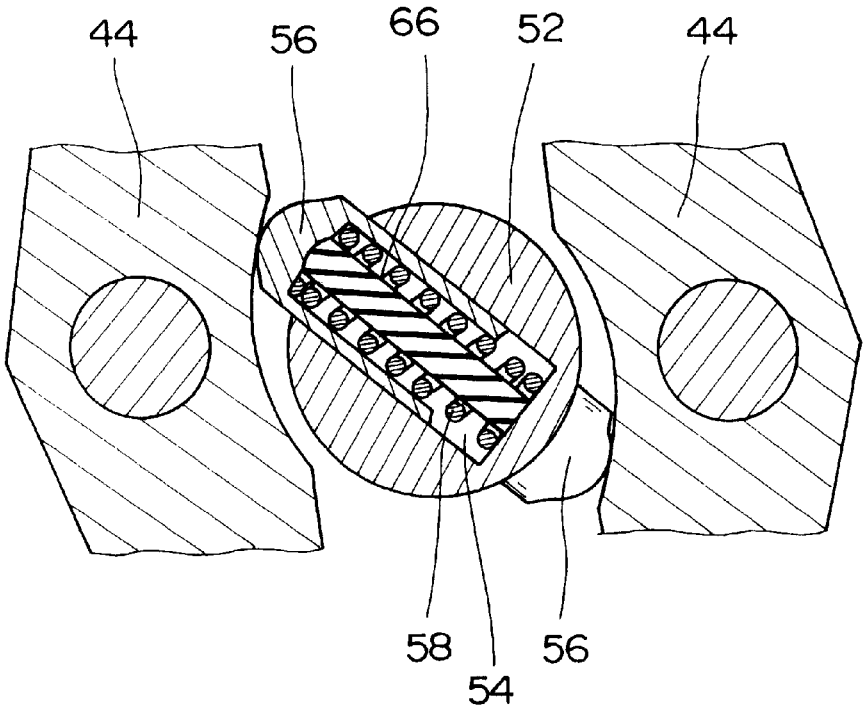
FIG. 2 is an enlarged sectional view of the main parts shown in FIG. 1.

In FIGS. 1 and 2, the same reference numerals as those used in FIGS. 12 to 19 indicate the same members, respectively. In the present invention, a switching member 52 is formed with two holes 54 which are perpendicular to the central axis and are axially spaced. The holes 54 open at positions opposite each other, i.e. 180 degrees from each other. Each hole 54 has one end closed and is internally provided with a tubular bushing pin 56, and a spring 58 within each bushing pin 56 to bias the bushing pin 56 outwardly. As shown in FIGS. 1 and 2, the closed end of the bushing pin 56 is biased by the spring 58 so as to project from the hole 54, and the outer surface of the closed end of the bushing pin 56 presses against a wing member 44. The structure mentioned so far is the same as the prior art.

In the present invention, an elastic member, such as rubber, is provided within the hole 54 to resist movement of the bushing pin 56. In FIGS. 1 and 2, an elastic member 66 in the shape of a solid rod extends axially within the inner space of the spring 58.

In the normal state, preferably, one end of the elastic rod 66 is brought into contact with the closed end of a tubular bushing pin 56, and the other end thereof is brought into contact with switching member 52. With the elastic rod 66 incorporated into the axial inner space of the spring 58, a compressive force may be either applied or not applied to the elastic rod 66. One end of the elastic rod 66 is brought into contact with the closed end of the bushing pin 56, and the other end is brought into contact with the switching member 52 as previously mentioned, but in the normal state, either end of the elastic rod 66 may not be in contact.

With the structure as described above, when an overshooting force is exerted on a wing member 44, the bushing pin 56 is pressed by the wing member 44 so that the elastic rod 66 and the spring 58 are compressed. Reaction against the compression is generated in the elastic rod 66 and the spring 58, and this reaction force prevents a pawl 46 of the wing member 44 from separation from internal gear 30 to the extent of overshooting.

The material for the elastic rod 66 is preferably less elastic under compression than spring 58 so that the elastic rod 66 functions as a stopper for the wing member 44 to prevent the pawl 46 of the wing member 44 from separating from the internal gear 30 to prevent an occurrence of overshooting.

Further, there sometimes appears a frequency at which vibrations of the wing member 44 and the spring 58 are amplified at the time of high speed rotation. In this case, since the rod 66 functions as a stopper or a damper relative to the wing member 44, it is possible to prevent an occurrence of overshooting even at the time of high speed rotation.

Besides, at the time of high speed rotation, the elastic rod 66 extends quickly relative to motion of the wing member 46, and even in the elastic rod 66 formed of elastic material, there occurs a large reaction force according to the pressing force with respect to the wing member 46. For this reason, since at the time of high speed rotation, the elastic rod 66 functions as a stopper or a damper, it is possible to prevent occurrence of overshooting even at high speed rotation.

Further, when the bushing pin 56 is pressed, the compressed elastic rod 66 comes in contact with the spring 58, and the vibrations of the bushing pin 56 and the spring 58 are absorbed by the elastic rod 66 to enable the suppression of the resonant phenomenon. Thus, it is possible to prevent an occurrence of overshooting also by suppressing the resonant phenomenon.

Furthermore, since the holding force of the switching member 52 with respect to the shank 36 is increased by the elastic rod 66, it is possible to prevent occurrence of unintended switching of the switching member 52.

While in the foregoing embodiment the shank 36 has been described as provided with two wing members 44, it is to be noted that the invention can be applied to an arrangement wherein one wing member 44 is provided.

Second Embodiment of the Invention

Figure 3:
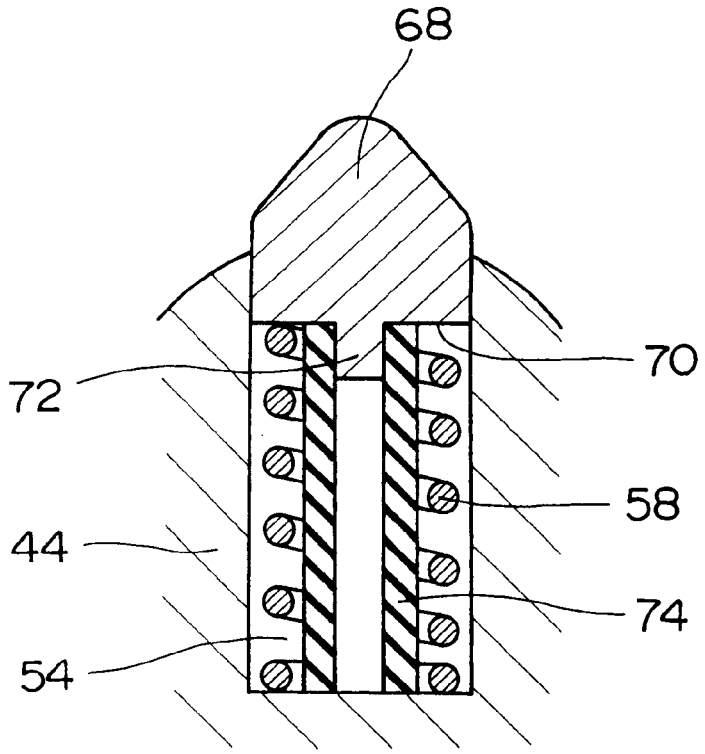
FIG. 3 is a sectional view showing a further embodiment of the bushing pin according to the present invention.

Next, FIG. 3 shows a further embodiment of the ratchet wrench according to the present invention.

Also in this embodiment, an elastic member is provided in a space along the center axis of the spring 58, similarly to FIGS. 1 and 2. In the bushing pin 68, a surface 70 facing the spring 58 is formed with a projecting pin 72 projecting internally of the hole 54. A tubular elastic member 74 is provided within an internal space of the spring 58, and the projecting pin 72 is fitted internally of the tubular elastic member 74

In the bushing pin 68, the surface 70 has a size so that both one end of the spring 58 and one end of the elastic member 74 may both contact same.

Also in this embodiment, when an overshooting force is exerted on the wing member 44, the tubular elastic member 74 is compressed along with the spring 58 by the bushing pin 68, and the reaction force of the elastic member 74 and the spring 58 prevents the pawl 46 of the wing member 44 from separating from the internal gear 30 to the extent of overshooting.

Third Embodiment of the Invention

Figure 4:
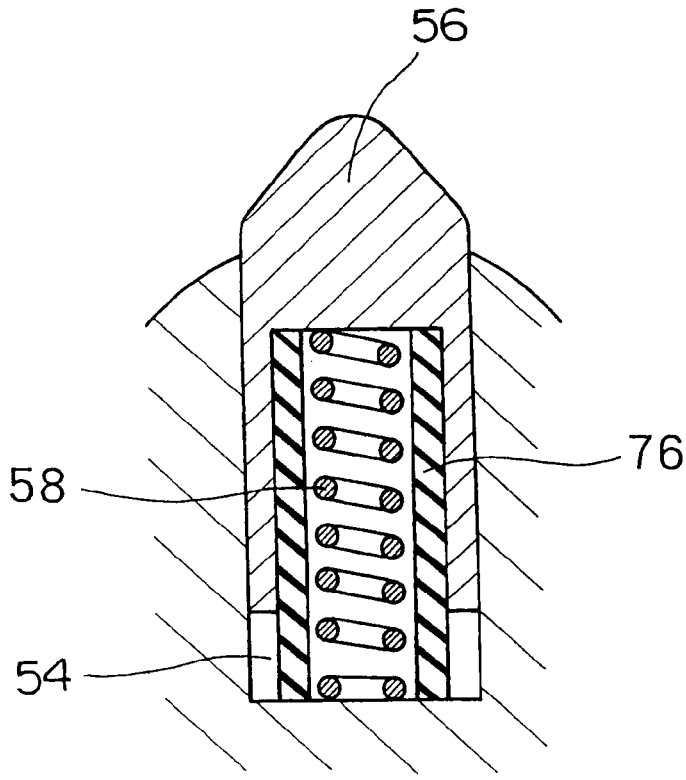
FIG. 4 is a sectional view showing yet another embodiment of the bushing pin according to the present invention.

FIG. 4 shows another embodiment of the ratchet wrench according to the present invention. In this embodiment, a tubular elastic member is provided externally of the spring 58.

This embodiment uses a tubular bushing pin 56 with one end closed as shown in FIGS. 1 and 2. The spring 58 and a tubular elastic member 76 are mounted in the internal space of the tubular bushing pin 56. The tubular elastic member 76 is arranged externally of the spring 58.

Also in this embodiment, when an overshooting force is exerted on the wing member 44, the tubular elastic member 76 is compressed along with the spring 58 by the bushing pin 56, and the reaction force of the elastic member 76 and the spring 58 prevents the pawl 46 of the wing member 44 from separating from the internal gear 30 to the extent of overshooting.

Fourth Embodiment of the Invention

Figure 5:
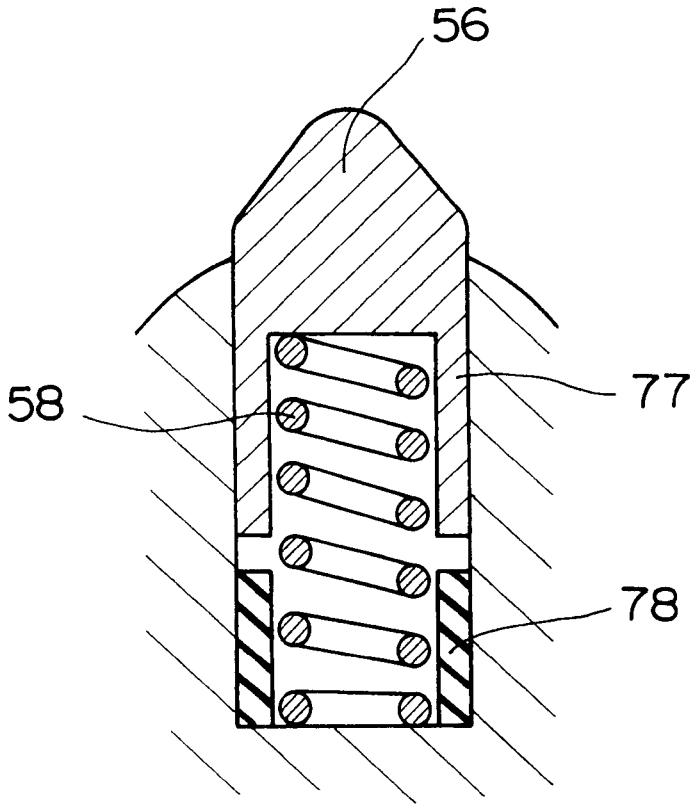
FIG. 5 is a sectional view showing still another embodiment of the bushing pin according to the present invention.

FIG. 5 shows another embodiment of the ratchet wrench according to the present invention. Also in this embodiment, a tubular elastic member is provided externally of the spring 58.

This embodiment also has a tubular bushing pin 56 with one end closed as shown in FIGS. 1 and 2. One end of the spring 58 is mounted in the internal space of the bushing pin 56 and its opposite end extends out of pin 56. A tubular elastic member 78 is provided surrounding that opposite end of the spring 56 and aligned with tubular portion 77 of the bushing pin 56, within the hole 54. The inside diameter and the outside diameter of the tubular elastic member 78 are preferably substantially the same as those of the tubular portion 77 of the bushing pin 56, but are not limited thereto.

Also in this embodiment, when an overshooting force is exerted on the wing member 44, the tubular elastic member 78 is compressed along with the spring 58 by the bushing pin 56, and the reaction force of the elastic member 78 and the spring 58 prevents the pawl 46 of the wing member 44 from separating from the internal gear 30 to the extent of overshooting.

While in FIG. 5 the bushing pin 56 and the tubular elastic member 74 are shown separated from each other, it is to be noted that normally they may be placed in contact.

Figure 6:
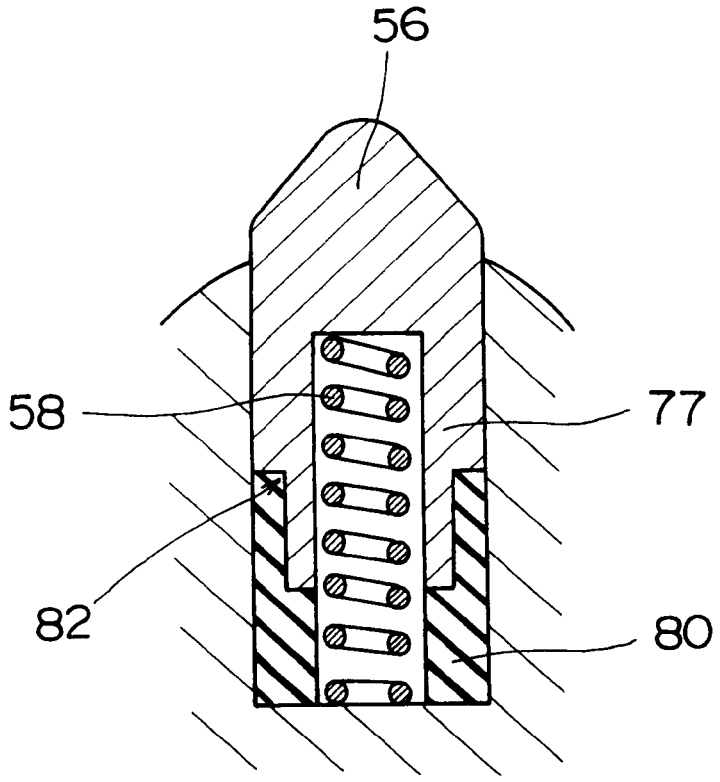
FIG. 6 is a sectional view showing a further embodiment of the bushing pin according to the present invention.

FIG. 6 shows a modified example of FIG. 5. In FIG. 6, the bushing pin 56 is in contact with a tubular elastic member 80, but the contact surface between the bushing pin 56 and the tubular elastic member 80 is stepped, with a shoulder 82 formed at the free end of the tubular portion (wall) 77 of the bushing pin 56, and a shoulder formed on the elastic member 80, which exactly mates with the shoulder 82 of the bushing pin 56. While the shoulder 82 of the bushing pin 56 is shown as external, with a central portion, it is to be noted that the shoulder may be internal so that an external portion extends from the shoulder.

Figure 7:
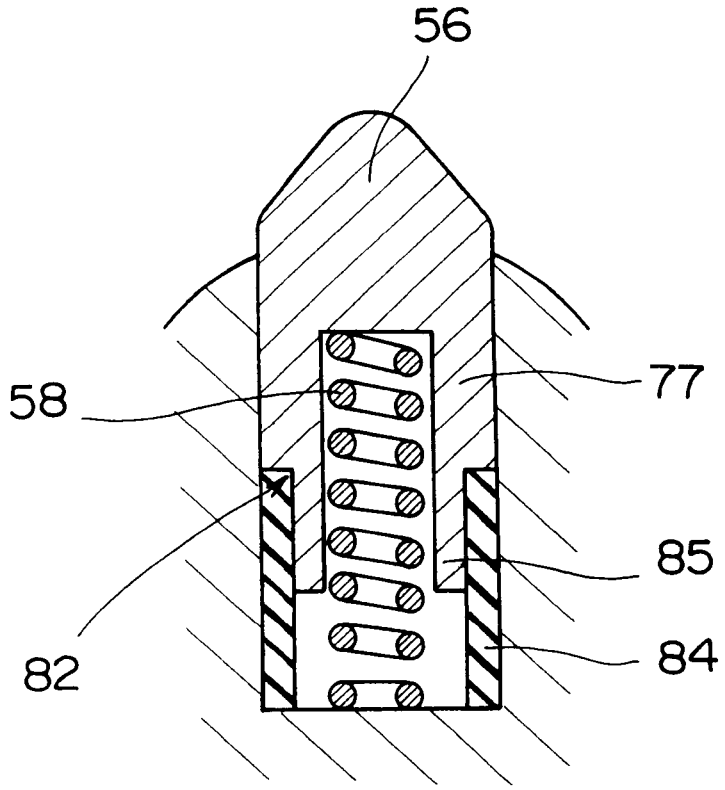
FIG. 7 is a sectional view showing another embodiment of the bushing pin according to the present invention.

FIG. 7 shows another modification of FIG. 5. In FIG. 7, as in FIG. 6, a shoulder 82 is formed at the tubular free end of the bushing pin 56. A tubular elastic member 84 is fit around the outside of an inner projecting portion 85 projected lengthwise in an axial direction from the shoulder 82 of the bushing pin 56. The wall-thickness of the elastic member 84 is about half of that of the elastic member 78 of FIG. 5 and the elastic member 80 of FIG. 6.

While in FIG. 7, the projecting portion 85 projected lengthwise in an axial direction from the shoulder 82 is an inner portion of tubular wall 77, the shoulder 82 may be internal to tubular wall 77 so that the tubular elastic member 84 is fitted internally of the projecting portion 85 of the bushing pin 56.

Fifth Embodiment of the Invention

Figure 8:
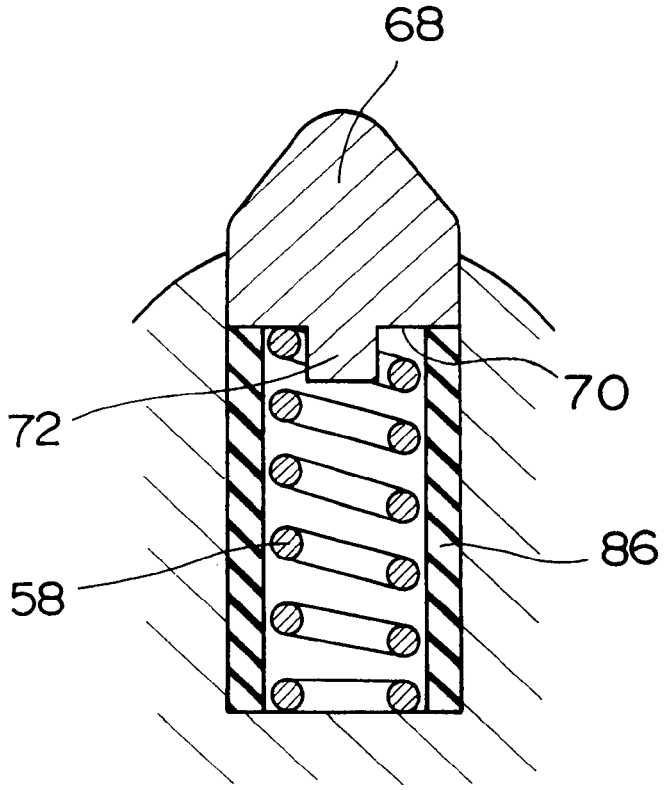
FIG. 8 is a sectional view showing yet another embodiment of the bushing pin according to the present invention.

FIG. 8 shows another embodiment of the ratchet wrench according to the present invention. Also in this embodiment, a tubular elastic member is provided externally of the spring 58. In this embodiment, the bushing pin 68 is provided with the projecting pin 72 as shown in FIG. 3. The internal space at one end of the spring 58 is fitted over the projecting pin 72. A tubular elastic member 86 is provided externally of the spring 58. One end of the spring 58 and one end of the elastic member 86 abutt the annular surface 70 of the bushing pin 56.

Also in this embodiment, when an overshooting force is exerted on the wing member 44, the tubular elastic member 86 is compressed along with the spring 58, and the reaction force of the elastic member 86 and the spring 58 prevents the pawl 46 of the wing member 44 from separating from the internal gear 30 to the extent of allowing overshooting.

Sixth Embodiment of the Invention

Figure 9:
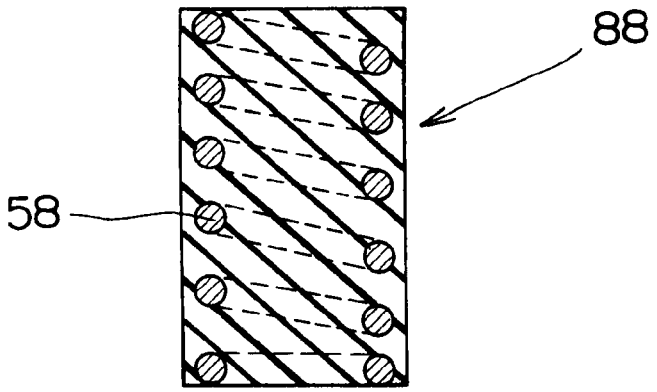
FIG. 9 is a sectional view showing a further embodiment of the bushing pin according to the present invention.

FIG. 9 shows still another embodiment of the ratchet wrench according to the present invention. FIG. 9 shows a solid elastic member 88 with a spring 56 embedded therein. The elastic member 88 with the spring 56 embedded therein is formed by molding. In this case, the bushing pin may be the tubular bushing pin 56 with one end closed as shown in FIGS. 1 and 4, or may be the tubular bushing pin 68 provided with the surface 70 as shown in FIGS. 3 and 8.

Also in this embodiment, the reaction force of the spring 58 and the elastic member 88 prevents the pawl 46 of the wing member 44 from separating from the internal gear 30 to the extent of allowing overshooting.

Figure 10:
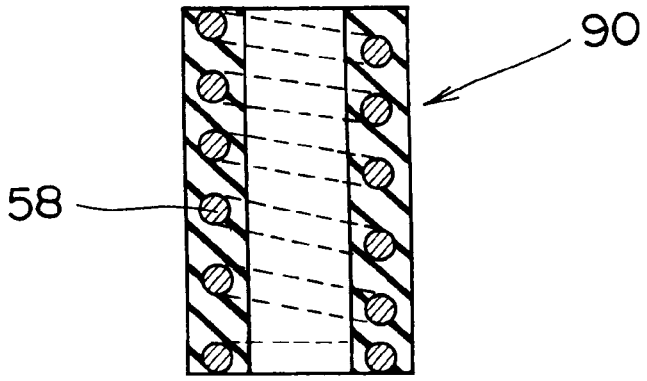
FIG. 10 is a sectional view showing another embodiment of the bushing pin according to the present invention.
Figure 11:
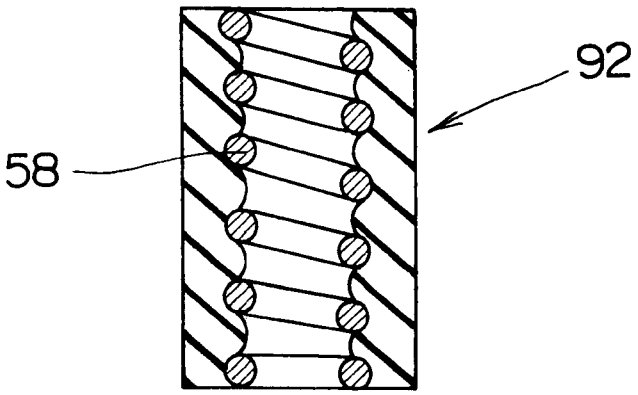
FIG. 11 is a sectional view showing still another embodiment of the bushing pin according to the present invention.
Figure 12:
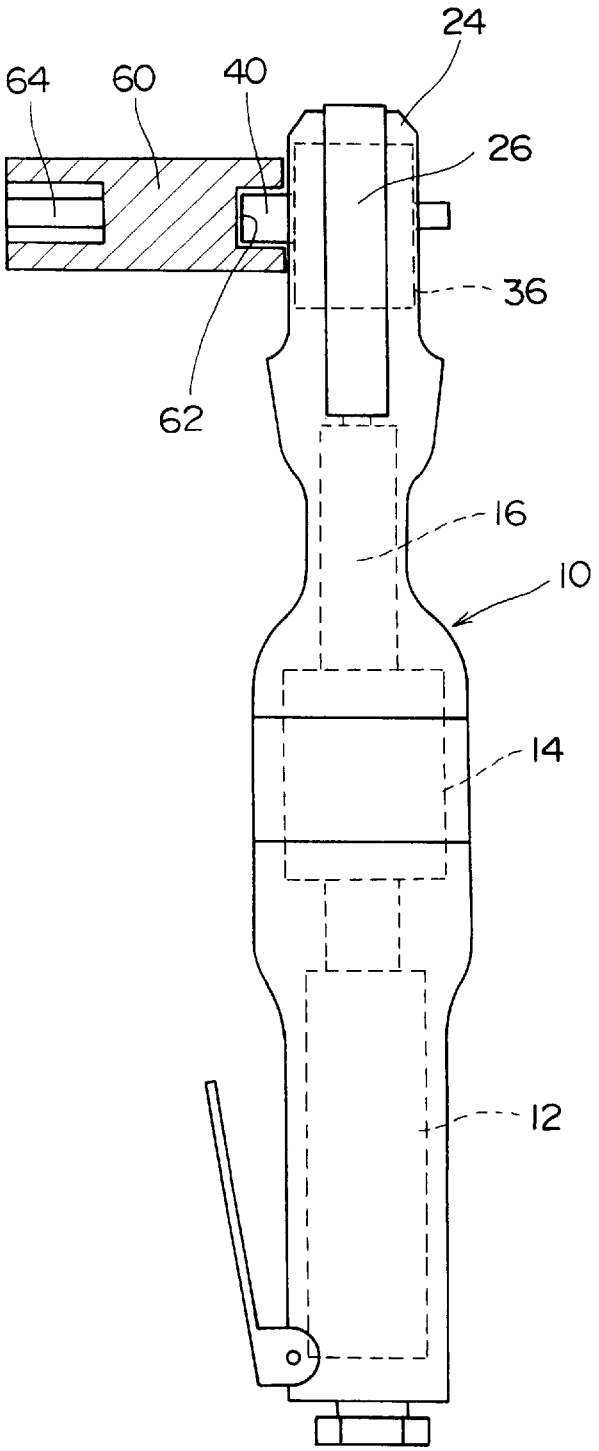
FIG. 12 (PRIOR ART)
FIG. 12 is a front view of a conventional ratchet wrench.
Figure 13:
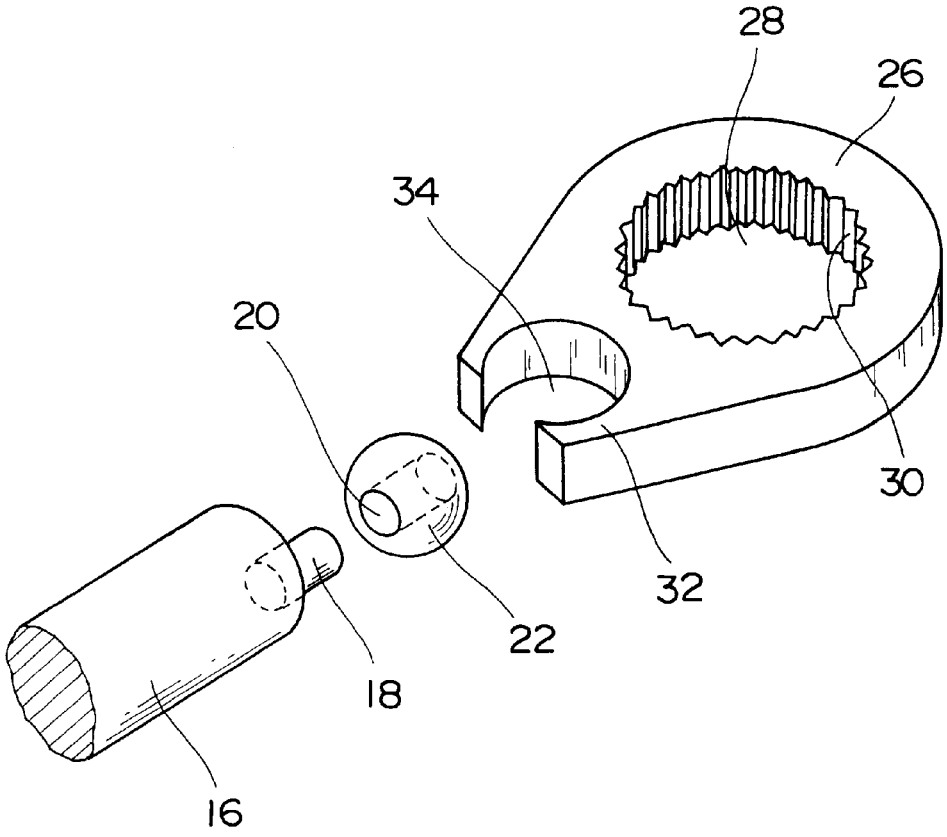
FIG. 13 (PRIOR ART)
FIG. 13 is an exploded perspective view showing the connection between a crank shaft and an oscillating member used in FIG. 12.
Figure 14:
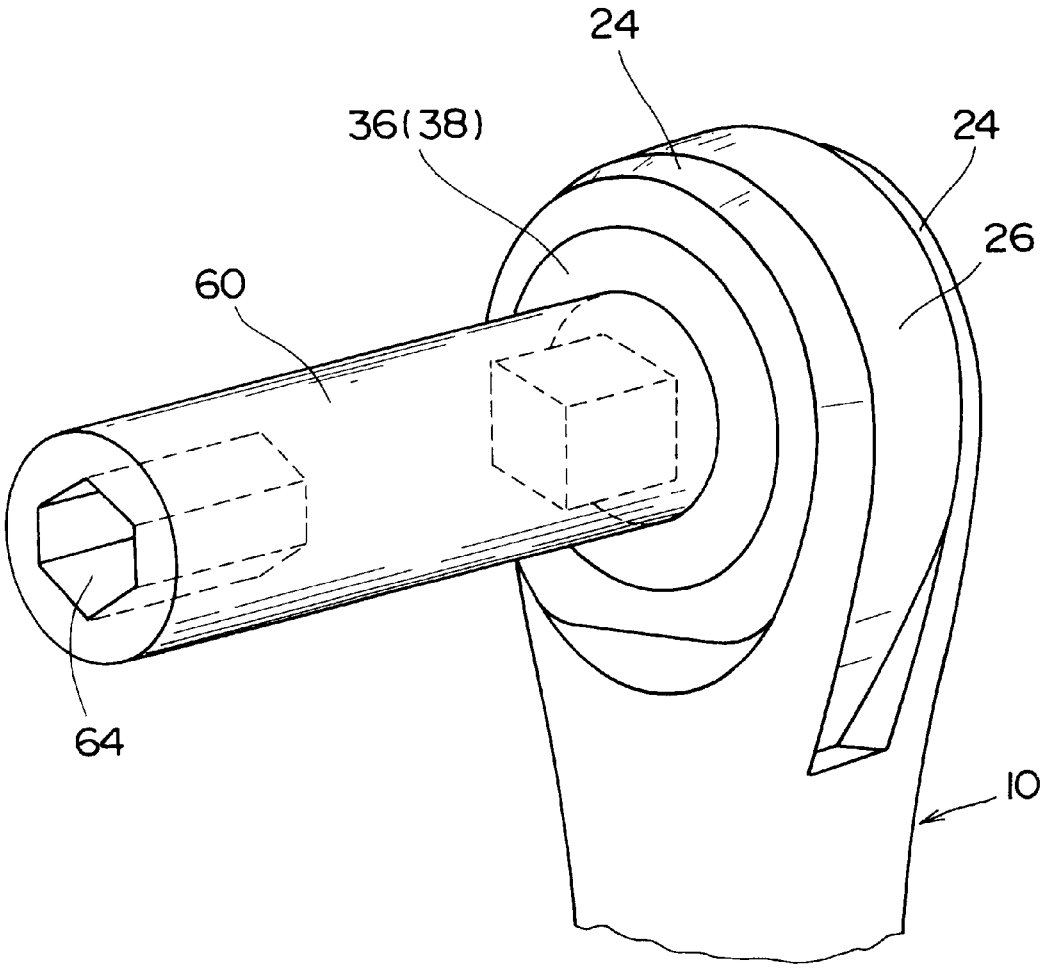
FIG. 14 (PRIOR ART)
FIG. 14 is a perspective view showing a socket mounted on the ratchet wrench shown in FIG. 12.
Figure 15:
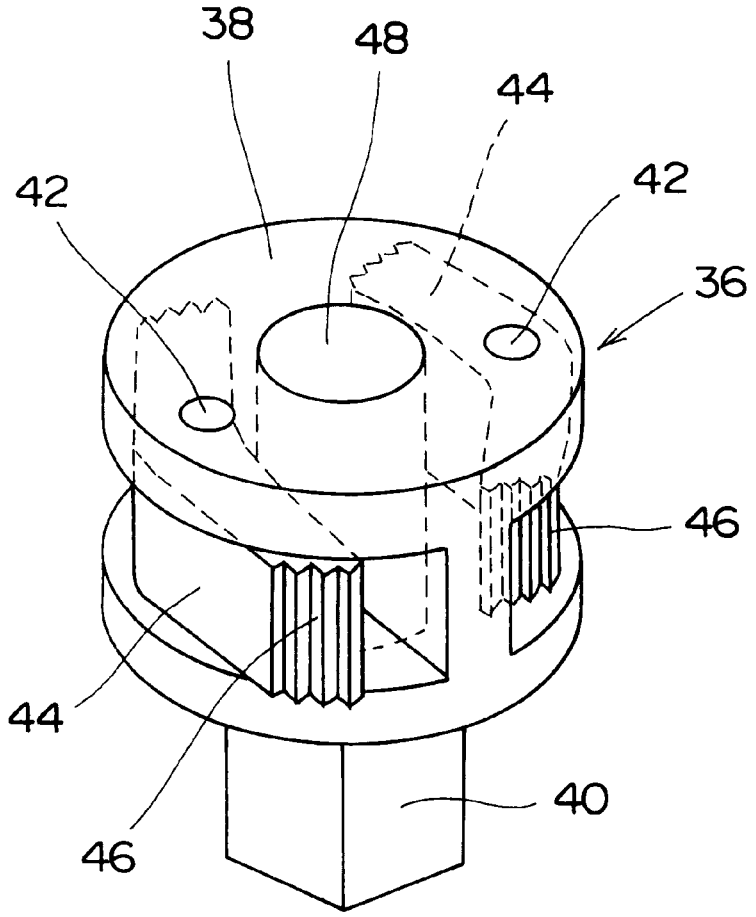
FIG. 15 (PRIOR ART)
FIG. 15 is a perspective view of a shank used in FIG. 12.
Figure 16:
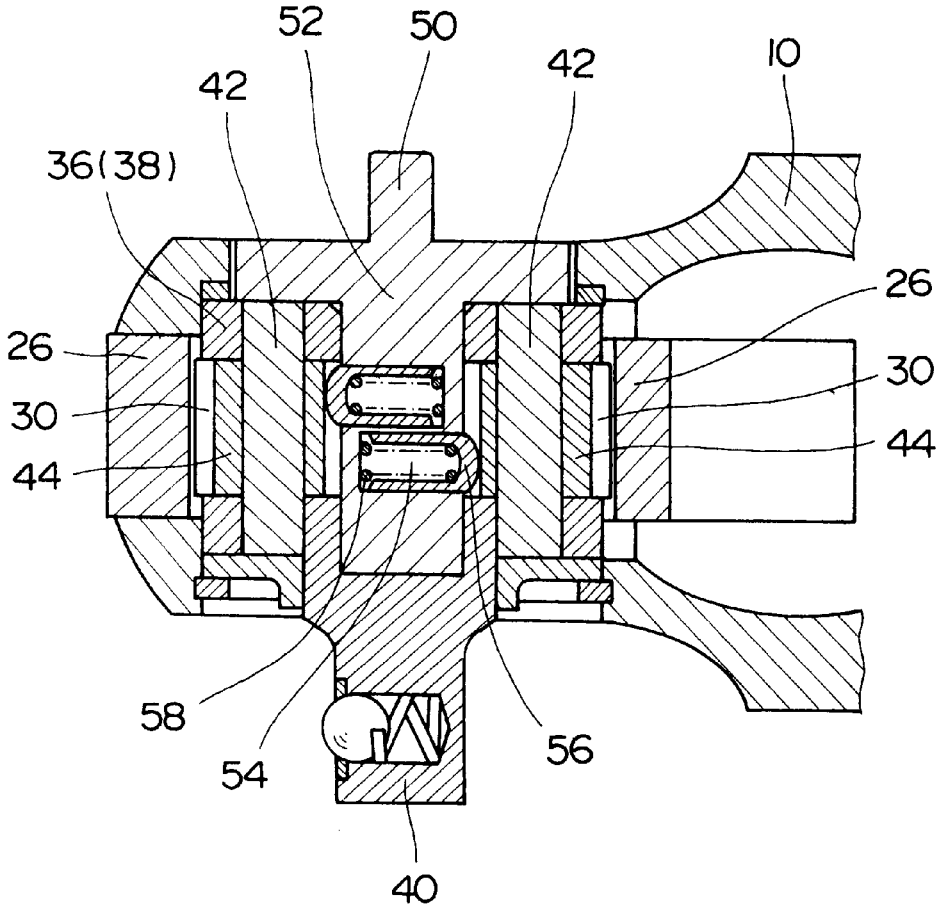
FIG. 16 (PRIOR ART)
FIG. 16 is a sectional view of main parts of the ratchet wrench shown in FIG. 12.
Figure 17:
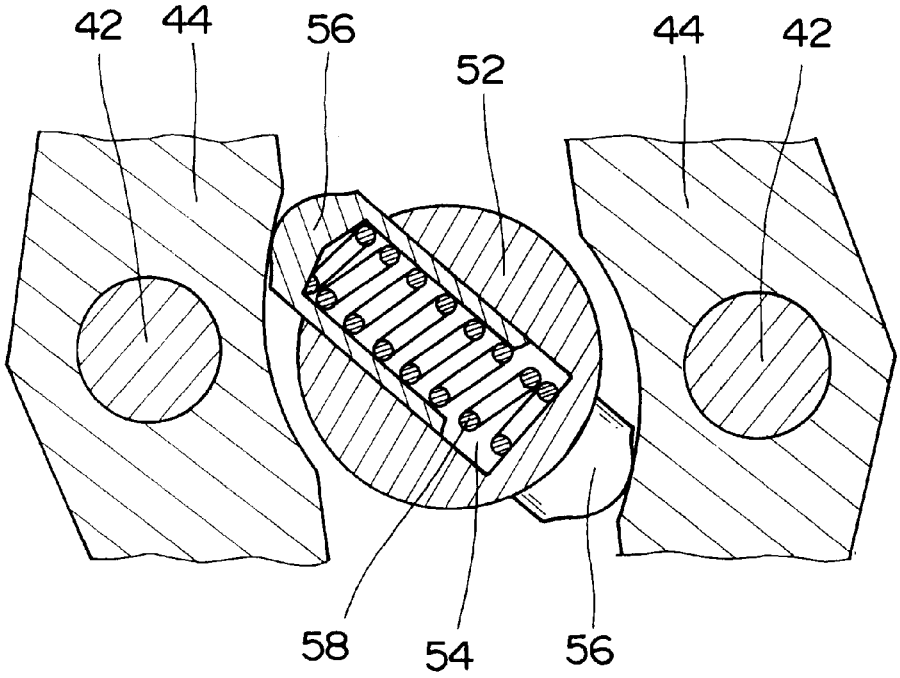
FIG. 17 (PRIOR ART)
FIG. 17 is an enlarged sectional view of the main parts shown in FIG. 16.
Figure 18:
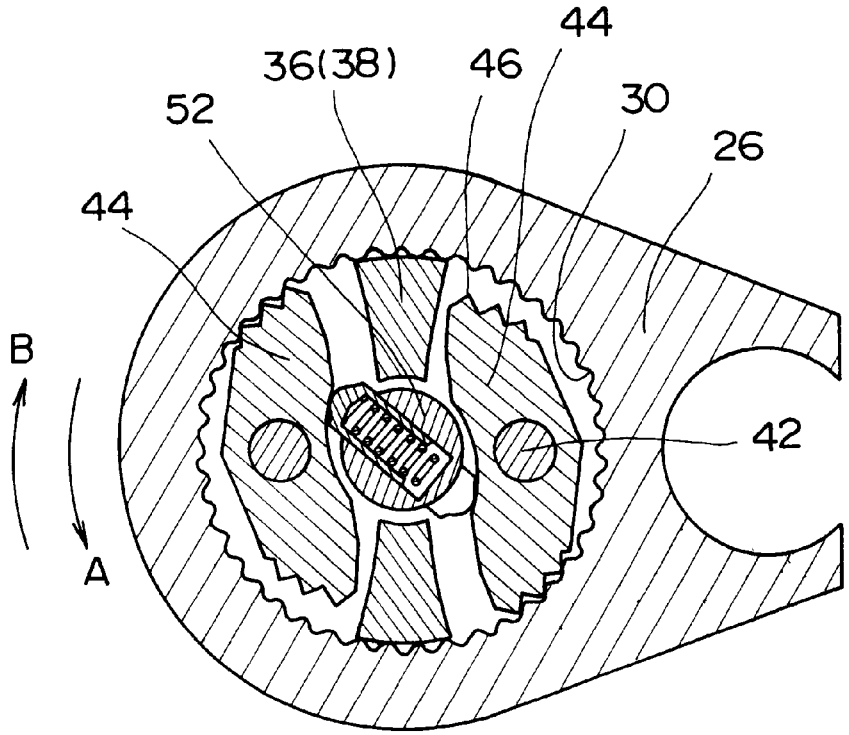
FIG. 18 (PRIOR ART)
FIG. 18 is a sectional view showing a state of good meshing of the oscillating member and the wing member in the ratchet wrench shown in FIG. 12.
Figure 19:
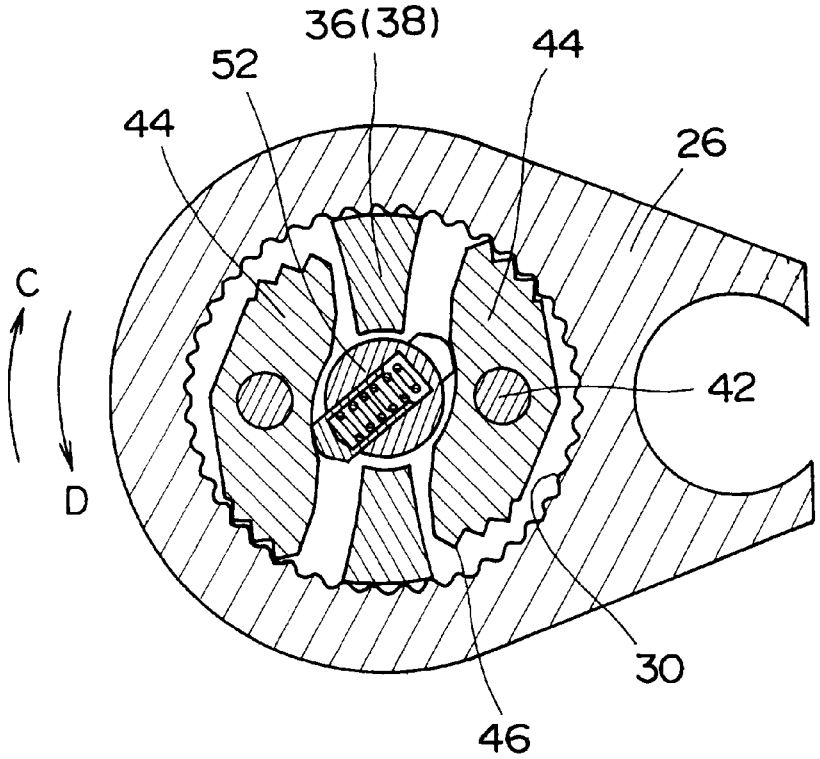
FIG. 19 (PRIOR ART)
FIG. 19 is a sectional view showing a good meshing state of the other of the oscillating member and the wing member in the ratchet wrench shown in FIG. 12.
Figure 20:
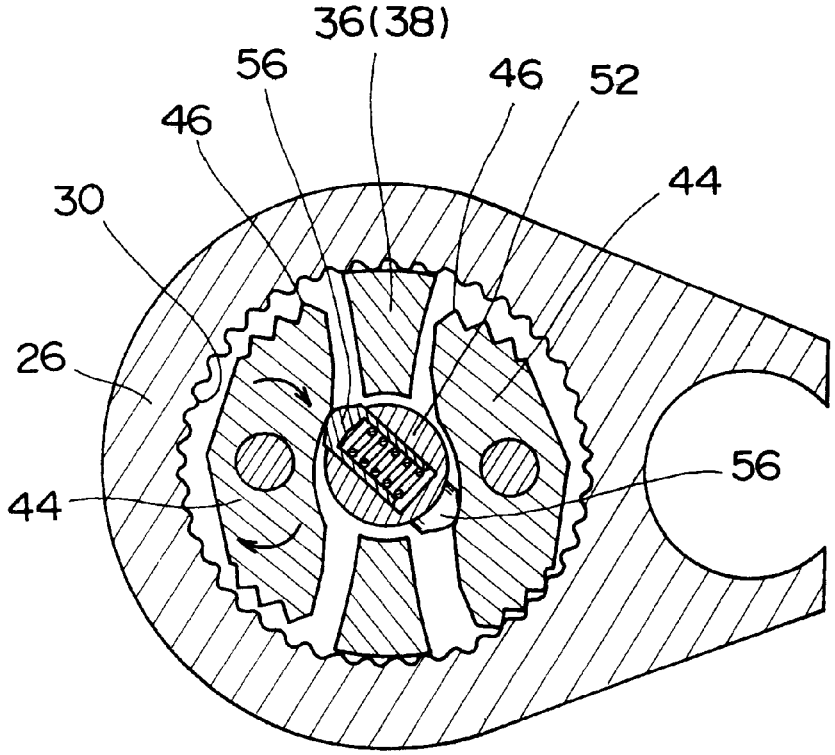
FIG. 20 (PRIOR ART)
FIG. 20 is a sectional view showing a state in which the oscillating member and the wing member in the ratchet wrench shown in FIG. 12 are disengaged.
Figure 21:
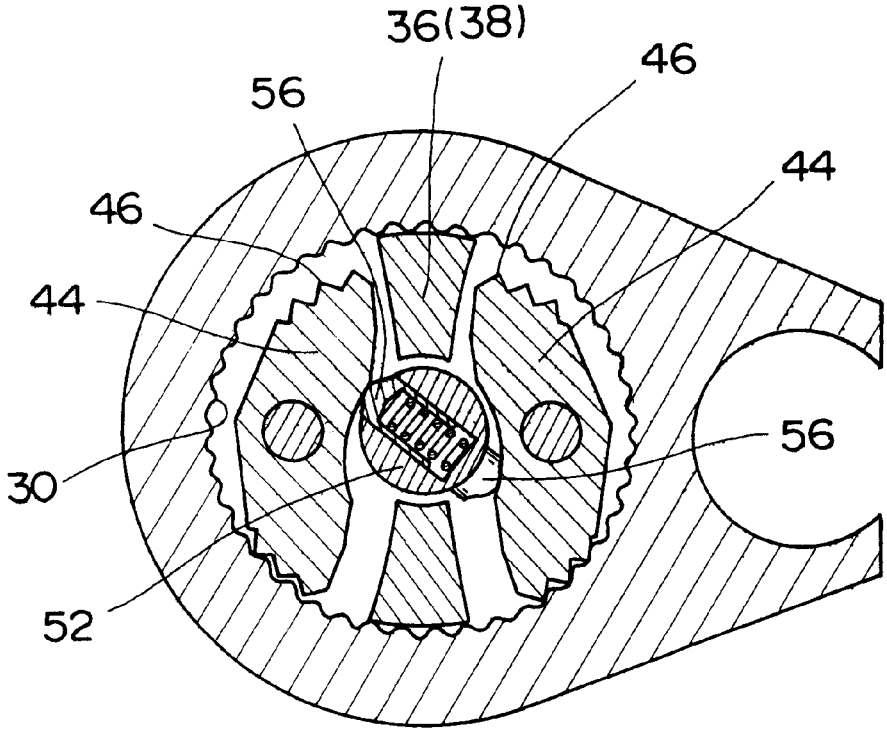
FIG. 21 (PRIOR ART)
FIG. 21 is a sectional view showing an inadequate meshing state between the oscillating member and the wing member in the ratchet wrench shown in FIG. 12.

In place of the arrangement shown in FIG. 9, there can be used an annular elastic member 90 having the spring 56 molded therein as shown in FIG. 10. Further, there can be used an arrangement wherein a tubular elastic member 92 is molded externally of the spring 56 as shown in FIG. 11.

As described above, according to the present invention, an elastic member such as rubber, which resists movement of a bushing pin into a hole, is provided within the hole along with a spring for biasing the bushing pin outwardly. As a result, even if an overshooting force is exerted on the wing member, or even if there appears a frequency at which vibrations of the wing member and the spring are amplified at the time of high speed rotation, it is possible to prevent the pawls of the wing members from separation from the internal gear to the extent of allowing overshooting by the combined reaction force the elastic member and the spring, and by the stopping function of the elastic member having a compression rate.

Furthermore, in the present invention, since the holding force of the switching member with respect to the shank can be increased by the spring and the elastic member, it is possible to prevent an unintended switching of the switching member.

What is claimed is:

1. A ratchet wrench, comprising: a housing, an oscillating member having an internal gear mounted on the housing for oscillating motion a shank provided with a center hole, a wing member having pawls meshed with the internal gear, a switching member mounted on the shank for rotation relative thereto through a given angle, and having a shaft portion fitted within said center hole, said shaft portion having a radial bore, a bushing pin and a spring provided within the radial bore for biasing said wing member in a direction bringing said pawls of said wing member into contact with said internal gear, and an elastic member mounted within said radial bore for resisting retraction of said bushing pin into said radial bore.

2. The ratchet wrench of claim 1, wherein said elastic member is provided within said spring and extends along a center axis of said spring.

3. The ratchet wrench of claim 2, wherein said bushing pin has a tubular shape with one end closed, one end of said spring is mounted in the tubular internal space of said bushing pin, and said elastic member is in the form of a rod.

4. The ratchet wrench of claim 2, wherein said bushing pin has a surface abutting said spring or said elastic member, said abutting surface being formed in its center with a projecting pin, said elastic member being tubular, and said projecting pin being fitted within said tubular elastic member.

5. The ratchet wrench of claim 1, wherein said elastic member is a tubular elastic member provided externally of said spring.

6. The ratchet wrench of claim 5, wherein said bushing pin has a hollow tubular shape with one end closed, one end of said spring and one end of said tubular elastic member being mounted in the hollow of said bushing pin.

7. The ratchet wrench of claim 5, wherein said bushing pin has a hollow tubular shape with one end closed, one end of said spring is mounted in the hollow of said bushing pin, and said elastic member is arranged abutting a free end of a tubular portion of said bushing pin and coaxial with said tubular portion.

8. The ratchet wrench of claim 7, wherein a first shoulder is formed at the free end of the tubular portion of said bushing pin, and a second shoulder, mating with the first shoulder of said tubular portions is formed on said tubular elastic member.

9. The ratchet wrench of claim 7, wherein a shoulder is formed at a free end of the tubular portion of said bushing pin, and said elastic member is fitted on an outer surface of a projecting portion extending from the shoulder of said tubular portion.

10. The ratchet wrench of claim 5, wherein said bushing pin has a surface abutting said spring or said elastic member, said abutting surface being formed in its center with a projecting pin, and said projecting pin being fitted in the internal space of said spring.

11. The ratchet wrench of claim 1, wherein said elastic member is a solid molding containing said spring.

12. The ratchet wrench of claim 1, wherein said elastic member is a hollow tubular element in which said spring is molded.

13. The ratchet wrench of claim 1, wherein said elastic member is a tubular element molded so as have an outside portion of said spring embedded therein.

14. The ratchet wrench of claim 1, wherein said elastic member is formed of rubber.

* * * * *

UNITED STATES PATENT AND TRADEMARK OFFICE

CERTIFICATE OF CORRECTION

PATENT NO. : 6,209,422 B1
DATED : April 3, 2001
INVENTOR(S) : Kamiya et al.

It is certified that error appears in the above-identified patent and that said Letters Patent is hereby corrected as shown below:

Column 2,
Line 42, "14.A" should read -- 14. A --.

Column 8,
Line 64, "portions" should read -- portion, --.

Signed and Sealed this

Seventh Day of May, 2002

*Attest:*

*Attesting Officer*

JAMES E. ROGAN
*Director of the United States Patent and Trademark Office*